US005249831A

United States Patent [19]

Maniaci

[11] Patent Number: 5,249,831

[45] Date of Patent: Oct. 5, 1993

[54] SECURITY LOCK FOR SAFES AND THE LIKE HAVING INERTIAL OPERATED COUNTERWEIGHT

[75] Inventor: Anthony C. Maniaci, Highland, Calif.

[73] Assignee: American Security Products Co., Fontana, Calif.

[21] Appl. No.: 801,341

[22] Filed: Dec. 2, 1991

[51] Int. Cl.[5] ..... E05B 63/14

[52] U.S. Cl. ..... 292/144; 292/DIG. 22; 292/2; 292/337; 292/DIG. 54; 109/59 R; 70/1.5

[58] Field of Search ..... 292/DIG. 22, 144, 1, 292/2, 337, 137, 163, 164, 183, 184, DIG. 44, DIG. 54, 150; 109/59 R, 63.5; 70/1.5, 1.7

[56] References Cited

U.S. PATENT DOCUMENTS

| | | | |
|---|---|---|---|
| 18,157 | 9/1857 | Perry | 70/1.5 |
| 1,431,571 | 12/1922 | Daly | 292/2 |
| 3,799,596 | 3/1974 | Nozomu et al. | 292/DIG. 22 |
| 3,921,541 | 11/1975 | Chartrand et al. | 109/59 R |
| 3,990,531 | 11/1976 | Register | 292/DIG. 22 |
| 4,080,810 | 3/1978 | Fishman | 292/137 |
| 4,147,044 | 4/1979 | Bernath | 70/1.5 |
| 4,249,469 | 2/1981 | Craske | 109/59 R |
| 4,470,275 | 9/1984 | Fisher | 70/1.5 |
| 4,520,736 | 6/1985 | Crosby et al. | 70/1.5 |
| 4,552,399 | 11/1985 | Atarashi | 292/DIG. 22 |
| 4,648,255 | 3/1987 | Gartner | 70/1.5 |
| 4,679,415 | 7/1987 | Spratt | 70/1.5 |

FOREIGN PATENT DOCUMENTS

| | | | |
|---|---|---|---|
| 1039879 | 9/1958 | Fed. Rep. of Germany | 292/244 |

*Primary Examiner*—Eric K. Nicholson
*Attorney, Agent, or Firm*—John H. Crowe

[57] ABSTRACT

A lock having a counterweight connected through a lever to a spring-actuated lock bolt on a safe to balance out any inertial forces tending to move the bolt out of its locking position when the safe is struck a heavy blow. A latch forming a part of the lock latches the bolt in its locking position when an attempt is made to dislodge or destroy the lock case or a part thereof. A selectively usable bolt part is effective to change the lock from a deadbolt type to a slam-bolt type.

5 Claims, 2 Drawing Sheets

SECURITY LOCK FOR SAFES AND THE LIKE HAVING INERTIAL OPERATED COUNTERWEIGHT

BACKGROUND OF THE INVENTION

1. Field of the Invention

This invention relates to locks and has particular reference to electrically controlled security locks used on safes and the like.

2. Description of the Prior Art

Although many different types of electrically controlled security locks have been used heretofore, it has been found that the simplest and most practical types utilize a lock bolt which is spring pressed into its locking position and is retracted into unlocking position by an electromagnetically operable device such as a solenoid. However, such locks have certain drawbacks which may permit unauthorized opening thereof by persons familiar with their construction and manner of functioning. Where the lock is incorporated in a safe, such a person would, for example, be aware that the safe could be dropped while in a position such that upon landing the momentum of the bolt would compress the spring and cause the bolt to move into its unlocking position. The same result could be achieved if the safe were given a heavy blow in a direction opposite to the direction of movement of the bolt. This type of blow causes the bolt, because of its inertia, to retract into said unlocking position.

In a safe with a lock of the above-described type, where a hole in the safe's door exists or is made by drilling, the lock can be released by forcing a suitable tool through the hole to dislodge the lock mechanism, or a part thereof, from its mooring on the door and thus disable the bolt.

SUMMARY OF THE INVENTION

A general object of the present invention is to provide a lock absent all of the above-noted deficiencies in locks of the above-indicated type.

A more narrowly stated object of the invention is to provide means for preventing release of a spring-pressed lock bolt upon delivery of a heavy blow to a safe or other structure incorporating the involved lock.

Another object of the invention is to provide a foolproof lock having a spring-pressed lock bolt.

Still another object of the invention is to provide a simple counterweight mechanism for preventing release of a spring-pressed lock bolt from locking position due to inertial forces brought to bear on the bolt.

A further object of the invention is to provide a device for preventing release of a spring-pressed lock bolt from locking position in a lock when the lock is disabled.

A still further object of the invention is to provide a lock of the above-indicated type which is of simple construction, economical to manufacture and highly reliable in use.

In the novel lock of the present invention, a lock bolt which is spring-pressed into locking position is connected through linkage to a counterweight that counterbalances the mass of the bolt so that the force of a blow struck against a case or safe in which the bolt is mounted, as when the safe is dropped, will be ineffective to move the bolt into its unlocking position.

An important feature of the invention is the presence of an auxiliary latch which becomes effective to positively lock the bolt in locking position when a part of the lock is dislodged or disabled.

An additional feature of the invention resides in selectively usable means effective to change the lock from deadbolt type to slam-bolt type.

BRIEF DESCRIPTION OF THE DRAWING

The manner in which the above and other objects of the invention are achieved will be readily understood from the following specification considered in conjunction with the accompanying drawing, wherein.

DESCRIPTION OF THE PREFERRED EMBODIMENT

Figure 2:
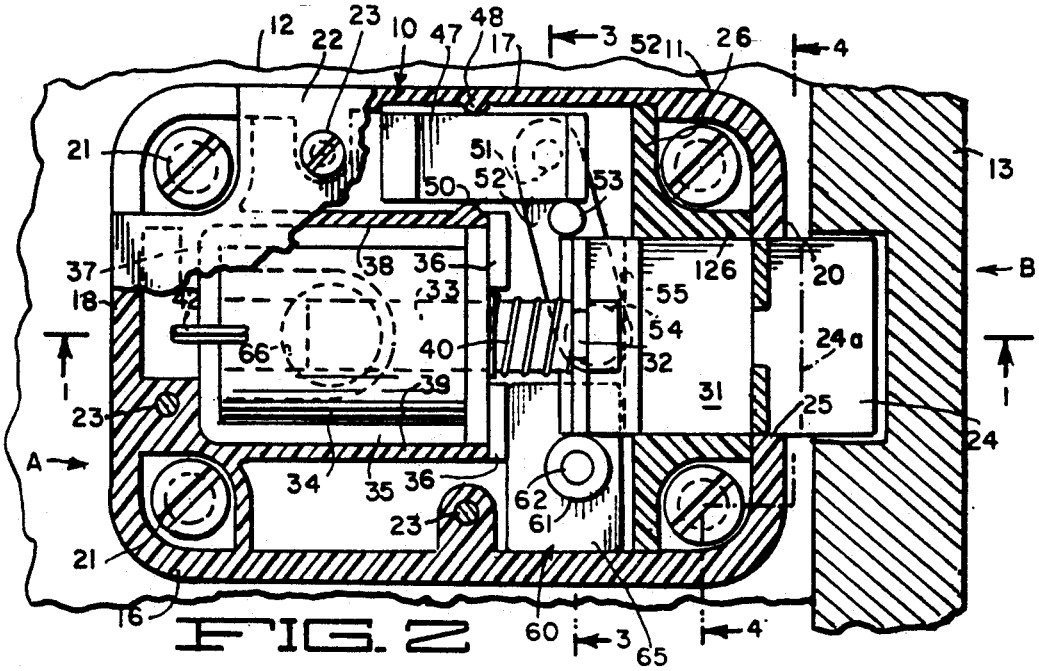
FIG. 2 is a rear sectional view thereof taken along line 2—2 of FIG. 1.

It should be understood that the present disclosure is to be considered only as an exemplification of the principles of the invention and is not intended to limit the invention to the embodiment illustrated. The scope of the invention is limited only by the language of the appended claims.

Referring to the drawing, the illustrated lock is indicated generally at 11 and is shown as attached to a swingable door 12 of a safe having enclosing walls, one of which is shown at 13. The latter forms a door jamb.

Figure 4:
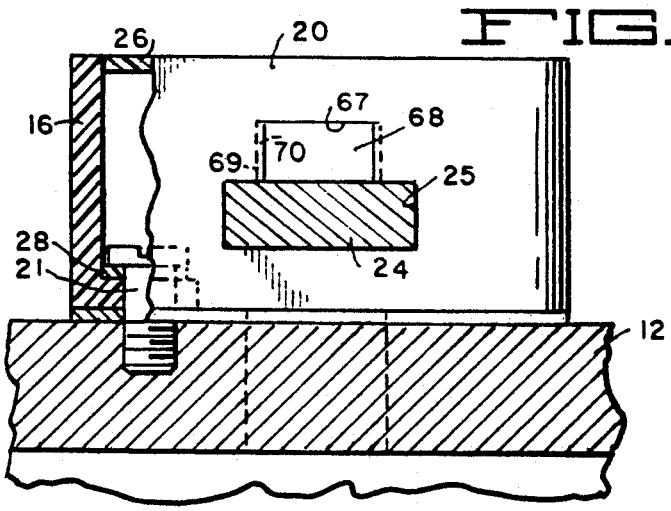
FIG. 4 is another transverse sectional view taken along line 4—4 of FIG. 2.
Figure 6:
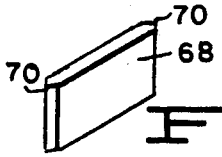
FIG. 6 is a perspective view of a removable plug for an opening to receive the slam-bolt attachment.
Figure 5:
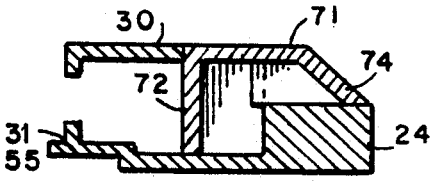
FIG. 5 is a sectional plan view taken in a direction similar to that of FIG. 1, illustrating the lock bolt with a slam-bolt attachment affixed thereto.
Figure 7:
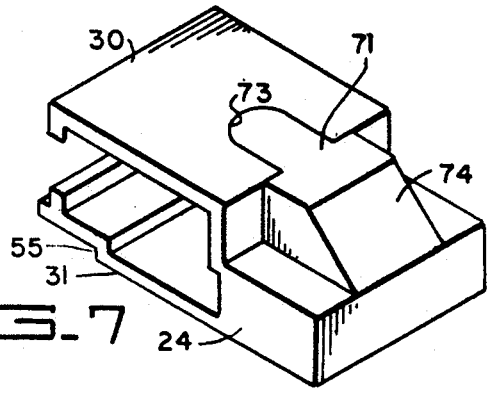
FIG. 7 is a perspective view of the lock bolt with the slam-bolt attachment thereon.

The lock 11 has a box-like case 10 which is open at its rear side and formed of a front wall 15, bottom wall 16, top wall 17 and end walls 18 and 20. The case is secured to the interior of the door 12 by four relatively strong screws 21 (FIG. 2 and 4). A cover plate 22 is secured to the rear side of the case by three relatively weak screws 23 and extends over most of the lock case.

Figure 1:
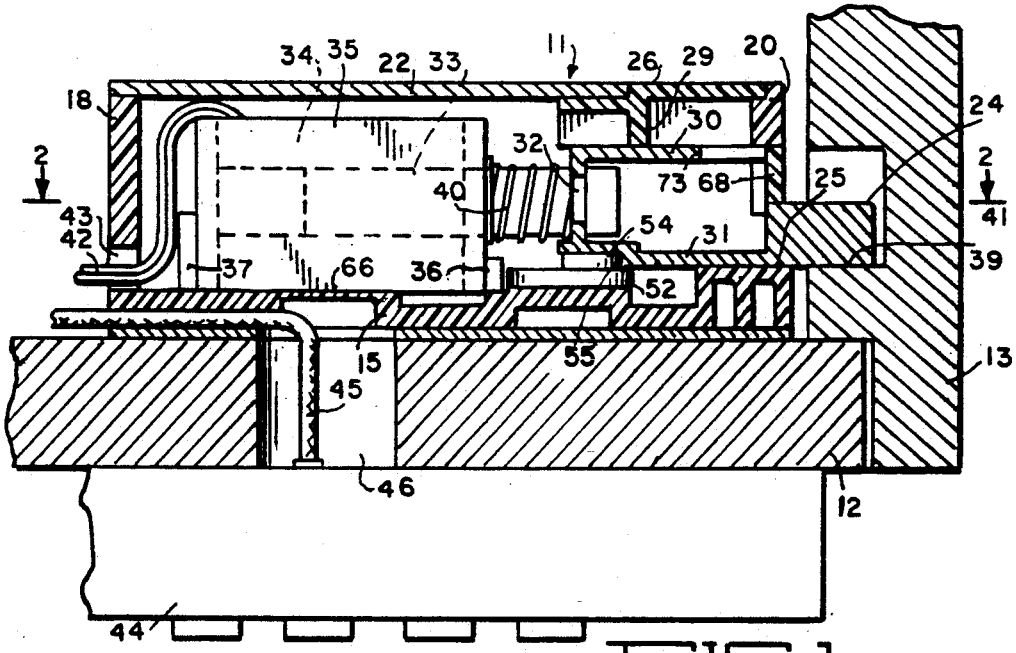
FIG. 1 is a sectional plan view of an embodiment of my novel lock and a portion of a safe in which the lock is mounted, taken mainly along line 1—1 of FIG. 2.

A deadbolt 24 is slidably supported for endwise movement through an opening 25 (FIG. 4) in the case wall 20, by an overlying part 29 (FIG. 1) of an auxiliary case part 26, the front wall 15 of the case and guide walls 126 (FIG. 2) of the case part 26. The case part 26 has foot ledges, one of which is shown at 28 (FIG. 4), by which the case part is held in place against the front case wall 15 by two of the mounting screws 21. Thus, the case part 26 forms an integral part of the case 10.

The bolt 24 has a pair of rearwardly extending jaw parts 30 and 31 which fit within an annular groove 32 in the armature 33 of a solenoid 34. The frame 35 of the solenoid is nested within retainer walls 36 to 39 upstanding from the case wall 15. A compression spring 40 is fitted over the armature 33 and is interposed between the solenoid 34 and the jaw parts of bolt 24 to urge the bolt into its illustrated locking position where it normally engages the strike edge 39 (FIG. 1) of a recess 41 in the side wall 13 of the safe.

Electrical conductors 42 connected to the solenoid 34 are led through an opening 43 in the case wall 18 to a suitable control module (not shown) located within the safe. The module is controlled by an electrical keyboard module 44 suitably mounted on the exterior of the safe door 12. An electrical cable 45 is led from the keyboard module 44 through a hole 46 in the safe door to the control module.

When a correct combination of keys on the keyboard module is depressed the control module is activated to energize the solenoid 34, thus retracting the bolt 24 into its unlocking position where its forward edge assumes a position indicated by the dot-dash lines 24*a* in FIG. 2. After a predetermined time period, the solenoid 34 is deenergized enabling the spring 40 to return the bolt 24 to its locking position.

Figure 3:
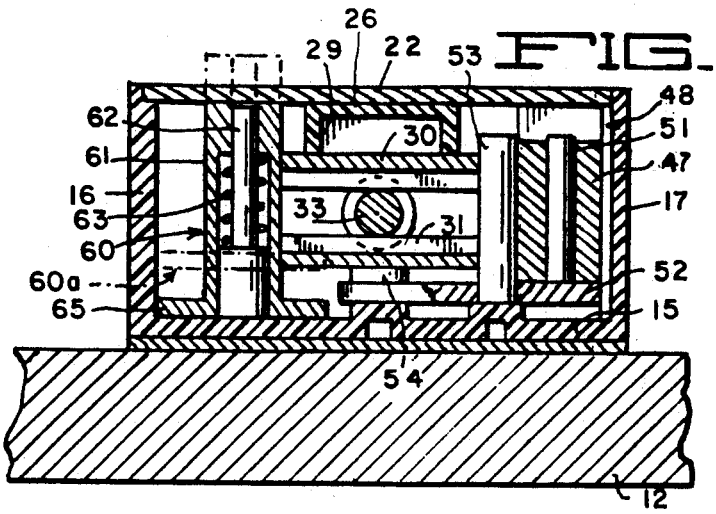
FIG. 3 is a transverse sectional view thereof taken along line 3—3 of FIG. 2.

In accordance with this invention, a counterweight 47 (FIG. 2 and 3) is slidably mounted between guide ridges 48 and 50 on the case wall 17 and solenoid retainer wall 38, respectively, and is pivotally connected to a pin 51 carried by a lever 52 fulcrummed intermediate its ends on a pivot post 53 upstanding from the case wall 15. The opposite end of the lever 52 carries a button 54 which lies in back of a shoulder 55 formed in the jaw 31 of bolt 24. The pivot post 53 also slidably guides one edge of the bolt 24.

The mass of the counterweight 47 and the relationship of the lever arms formed by the lever 52 are preferably such that they exactly counterbalance the mass of the bolt 24 and armature 33. Thus, if the safe is struck a heavy blow in the direction of the arrow A in FIG. 2 or is dropped in the direction of the arrow B. The inertial forces developed in the bolt 24 and armature 33 will be balanced by the inertial forces developed in the counterweight 47 and there will therefore be no tendency for the bolt to retract into its unlocking position.

Also in accordance with the present invention, means are provided to prevent release of the lock bolt 24 from its locking position in the event the lock is tampered with by forcing a rod or other tool (not shown) through the hole 46 in the door 12 in an attempt to dislodge the lock from its mooring or to destroy the same. For this purpose, an auxiliary or relock latch 60 (FIG. 2 and 3) is provided comprising a cylindrical body 61 slidably mounted on a stepped guide post 62 upstanding from the case wall 15. A compression spring 63 is fitted around a reduced portion of the post 62 and interposed between an annular shoulder on the body 61 and a shoulder on the post 62 to urge the latch rearward against the cover plate 22. Normally, when the plate 22 is in place, it holds the latch in its lower full line illustrated position wherein a latching foot 65 thereon is located below the level of the bolt shoulder 55.

It will be noted that the case wall 15 has a section 66 (FIG. 1) of reduced thickness in line with the door hole 46. Therefore, if an attempt is made to render the lock ineffective by removing the keyboard module 44 and driving a rod or other tool (not shown) through the hole 46, the tool can easily break the section 66 and force the solenoid 34 outwardly from its retainer walls 36 through 39 and about its connection with the bolt jaws 30 and 31, thus breaking the relatively weak retaining screws 23 and allowing the cover plate 22 to become separated from the case. Accordingly, the spring 63 will force the latch 60 rearward over the post 62 into a position depicted by dot-dash lines 60*a*, enabling its latching foot 65 to contact the bolt shoulder 55 and thereby latch the bolt in locking position even though the solenoid may be dislodged or destroyed.

Means are provided to change the lock from its normal deadbolt condition shown in FIG. 1 to 4, wherein the bolt 24 must be retracted to unlocking position to close the safe door, to a slambolt condition wherein the bolt is cammed into retracted position when the safe door is closed and thereafter spring pressed into locking position. In this connection, attention is called to FIG. 1 and 4 to 7 wherein it will be seen that the bolt opening 25 is formed with an added rectangular opening 67 which is normally closed by a plug member 68 having V-shaped edges 70 which snugly fit within mating grooves 69 in the opening 67.

A cam member 71 is provided having a downward extension 72 adapted to snugly fit in a mating opening 73 formed in the upper jaw 30 of the bolt 24. The forward end of the member 71 is inclined at 74 to form a camming surface to cam over the edge of the safe wall 13 when the safe door 12 is being closed whereby to retract the bolt against the force of spring 40 until the bolt passes over the strike edge 39 whereupon it will be moved back to locking position by spring 40.

When the camming member 71 is to be installed on the bolt 24, the plug 68 is removed to allow the member to extend through the opening 67. However, the member 71 may be readily removed at any time to return the lock to its normal deadbolt condition, in which case the plug 68 is refitted in the opening 67.

Although the lock 11 is depicted as mounted to directly lock the safe door 12 to the safe wall 13, it will be understood by those skilled in the art that other forms of locking arrangements may be employed under control of the lock. For example, the lock may be used to lock a suitable bolt work mechanism (not shown) using multiple lock bolts to effect locking and unlocking of the safe door.

From the foregoing it will be seen that I have provided a novel lock intended for safes and like security environments, utilizing a spring-actuated lock bolt, with simple and yet highly reliable means to prevent unauthorized release of the lock through the use of inertial forces or by the disabling of the lock or part thereof. Also, the versatility of the lock is increased considerably by the provision of a simple part effective to change the lock from a deadbolt type to a slam-bolt type.

I claim:

1. A lock suitable for use on safes comprising:

a bolt moveable between locking and unlocking positions, said bolt having a shoulder;

drive means for moving said bolt to its unlocking position;

spring means for urging said bolt to its locking position;

a counterweight; and linkage means interconnecting said counterweight and said bolt in a manner to oppose inertial forces tending to move said bolt to said unlocking position from said locking position, said linkage means comprising:

a lever, means pivotally connecting one end of said lever to said counterweight, means on said lever adjacent its opposite end adapted to engage said shoulder, and means pivotally supporting said lever intermediate its ends.

2. A lock as defined in claim 1 wherein the means pivotally supporting said lever comprises a pivot post serving to help the lever guide said bolt between its locking and unlocking positions.

3. A lock as defined in claim 1 including:

a lock case having means supporting said bolt for movement between its locking and unlocking positions, a latch, second spring means adapted to move said latch to latch said bolt in its locking position, and a cover for said case, said cover serving to normally maintain said latch out of said latching position and being positioned to release said second spring means to move said latch into its bolt latching position upon removal of said cover from said case.

4. A lock as defined in claim 3 wherein said latch helps to guide said bolt between said locking and unlocking positions.

5. A lock as defined in claim 1 including a lock case and wherein the means pivotally supporting said lever comprises:

a pivot post positioned adjacent one side of said bolt, said post serving to guide one side of said bolt for movement between its locking and unlocking positions, a second post positioned adjacent the other side of said bolt, a latch, second spring means adapted to move sad latch along said second post to latch said bolt in said locking position, and a cover for said case, said cover normally serving to maintain said latch out of latching position and releasing said second spring means to move said latch into said latching position upon removal of said cover from said case, said latch serving to guide said other side of said bolt between its locking and unlocking positions.

* * * * *